US006401318B1

(12) United States Patent
Bruyn

(10) Patent No.: US 6,401,318 B1
(45) Date of Patent: Jun. 11, 2002

(54) APPARATUS FOR SECURING INTERFACE STRIPS AT ROAD/RAIL CROSSINGS

(75) Inventor: Dominicus Bruyn, Cambridge (CA)

(73) Assignee: Performance Polymers Inc., Cambridge (CA)

( * ) Notice: Subject to any disclaimer, the term of this patent is extended or adjusted under 35 U.S.C. 154(b) by 0 days.

(21) Appl. No.: 09/105,801

(22) Filed: Jun. 12, 1998

(30) Foreign Application Priority Data

Jun. 16, 1997 (GB) ..... 9713171

(51) Int. Cl.[7] ..... B25B 27/14

(52) U.S. Cl. ..... 29/271; 29/559; 269/249; 269/270; 238/8; 238/378

(58) Field of Search ..... 29/460, 559, 257, 29/271, 238; 404/75; 269/249, 268, 270; 238/2, 8, 315, 310, 377, 378

(56) References Cited

U.S. PATENT DOCUMENTS 291,248 A * 1/1884 West ..... 269/249
3,934,316 A * 1/1976 Driscoll ..... 24/243
5,181,657 A * 1/1993 Davis ..... 238/8
5,241,736 A * 9/1993 Allison ..... 28/257
5,423,525 A * 6/1995 Spainhower ..... 269/249
5,538,182 A * 7/1996 Davis et al. ..... 238/8
5,899,379 A * 5/1999 Bruyn et al. ..... 238/8

FOREIGN PATENT DOCUMENTS

DE 3511552 * 10/1985 ..... 238/2

* cited by examiner

*Primary Examiner*—David P. Bryant
*Assistant Examiner*—Jermie E. Cozart
(74) *Attorney, Agent, or Firm*—Anthony Asquith & Co.

(57) ABSTRACT

At a crossing, rubber interface strips are positioned between the rails and the asphalt or concrete. A U-shaped spring-clip fits underneath the rail, and has upstanding arms that carry tappets, which engage the strips. One of the arms is threaded, and carries a screwed tappet-rod. Turning the tappet-rod closes the distance between the tappets, clamping the strips onto the sides of the rail, and forcing the springy arms apart. The spring-clips are manipulated into position while in an unstressed condition. The spring-clip is only brought up to force when finally assembled. Assembly can be done without tools, and with little danger of mis-assembly, or of injury to workers.

8 Claims, 4 Drawing Sheets

APPARATUS FOR SECURING INTERFACE STRIPS AT ROAD/RAIL CROSSINGS

This invention relates to road/rail level-crossings, and in particular to the installation of the rubber interface strips that fit between the metal rail and the asphalt or concrete of the road.

Rubber strips of the kind with which the invention is concerned are shown, for example, in patent publication CA-1,194,010 (EPTON, Sep. 24, 1985).

BACKGROUND TO THE INVENTION

A problem with the rubber strip interface systems has been in the manner of attaching the rubber strip to the rail. It is necessary for the strips to be held firmly against the sides of the rail while the asphalt or concrete is being applied. If the strips can become loose relative to the rails at this time, the effect is that the road material cannot be properly compacted, which can have which has a serious effect on the service life of the crossing. When a crossing needs repair, it is usually because the road material has cracked or crumbled particularly at the line where the road material touches the rubber strips, and care in keeping the strips tight against the rails when the road material is being applied can make a difference of several years before the onset of crumbling at this line. The major purpose in providing rubber interface strips is to protect the road material from crumbling, but the system can only achieve its potential in this regard if the strips are held firmly against the rails when the road surface is being applied.

Once the road surface has been applied, and has hardened, the road material itself acts to hold the strips against the rails. That is to say, the road material supports the strips, while at the same time, of course, the strips support the road material.

The present invention is aimed at making it possible to squeeze the rubber pieces tightly against the side of the rail with a strong and reliable gripping force. It is also an aim that the means for applying the force can be assembled, and the heavy squeezing forces can be generated, using inexpensive components, which can be installed simply and safely.

While repairs are being carried out to a road-rail crossing, it is usually necessary to close the crossing to both road and rail traffic. Therefore, it is important that the work be completed quickly. Since the work is done relatively infrequently at a given location, it is not uncommon for the work crew to include many workers who have never worked on a crossing before. While the work should be done quickly, the emphasis is not that minutes count, but rather that the work must be completed within the allowed window of time. The designer of the repair system should see to it that the work can be completed without the need for special tools, and in a manner that requires no more than a minute or two of training. Safety of workers who are generally unfamiliar with the tasks is important. It is important that the preparations prior to pouring the asphalt or concrete be easy to inspect; i.e the engineer should be able to tell at a glance that all the work has been completed and has been done properly. The less time and skill he has to expend in checking, and the more plainly obvious it is that incomplete work is incomplete, the better. It is very expensive to come back later to correct any problems.

THE PRIOR ART

Traditionally, in order to hold a rubber interface strip against the side of the rail, a spike has been driven partially into the wood of the cross-tie, and the protruding head of the spike bent over until it touches the rubber. The spike-head is bent over by striking it in a lateral direction with a hammer. Such a system, i.e bending partially-driven spikes over into contact with the strips, contains the potential for a number of problems, such as damage to the wood, improper bending over of the spike head, etc.

An example of the bent-over spike system is shown in the publication entitled EPTON RAILSEAL.

In many jurisdictions, bending the spikes over is unacceptable, not least because of the high risk of injury to the installation workers. Also, of course, when the cross-ties are made of concrete, spikes cannot be driven-in in any event. For such cases, U-shaped spring-clips have been proposed, which lie underneath the rail, the arms of the spring-clip being bent apart in order to load the rubber strips laterally against the sides of the rail. The problem with the traditional spring-clip is that it is difficult to apply the heavy forces necessary to install the spring-clip into place over the strips, at least in the absence of elaborate special tools. It is recognised that the skill level required for installing these spring-clips efficiently (and safely) is somewhat outside the traditional level at which contractors for repairs to level-crossings operate. In fact, the skill level needed to install spring-clips is unlike that needed generally for the rest of the tasks involved when repairing level-crossings, and the contractor does not wish to engage specially-trained operators just for that one task.

Indeed, it may be pointed out that the task of securing the rubber strips by side-hammering partially-driven spikes is not in keeping either with the rest of the tasks involved when repairing level-crossings, which is another reason why bending spikes over is not favoured. Even so, driving railway spikes is a widespread recognised skilled trade, whereas installing spring-clips is not.

An example of the traditional type of U-shaped spring-clip is shown in the publication entitled EPTON RAILSEAL FOR CONCRETE TIE APPLICATION.

It is another aim of the present invention that the system for securing the rubber strips to the sides of the rails be foolproof, whereby even an unskilled novice labourer cannot assemble the components wrongly, nor can he hurt himself.

GENERAL FEATURES OF THE INVENTION

The system of the invention involves the use of a metal (e.g spring-steel) spring-clip. The spring-clip is of a U-configuration, having a central beam and having left and right arms integrated therewith. Left and right tappets are arranged for contact with left and right tappet-receiving points (e.g grooves) on the side-surfaces of the strips. In the invention, one of the tappets is adjustable relative to the arm on which it is mounted. The tappet can be forcefully adjusted away from the arm, preferably, for example, by means of a screw thread connection between the tappet and the arm. To install the strips: first, the clips are manipulated underneath the rail; then, the strips are placed against the rail; then, the clips are manoeuvred into place around the strips; then, the tappet is adjusted away from the arm, into contact with the strip, which bends the two arms apart and thereby clamps the strips to the sides of the rail.

DETAILED DESCRIPTION OF PREFERRED EMBODIMENTS

By way of further explanation of the invention, exemplary embodiments of the invention will now be described with reference to the accompanying drawings, in which.

The apparatuses shown in the accompanying drawings and described below are examples that embody the invention. It should be noted that the scope of the invention is defined by the accompanying claims, and not necessarily by specific features of exemplary embodiments.

Figure 1:
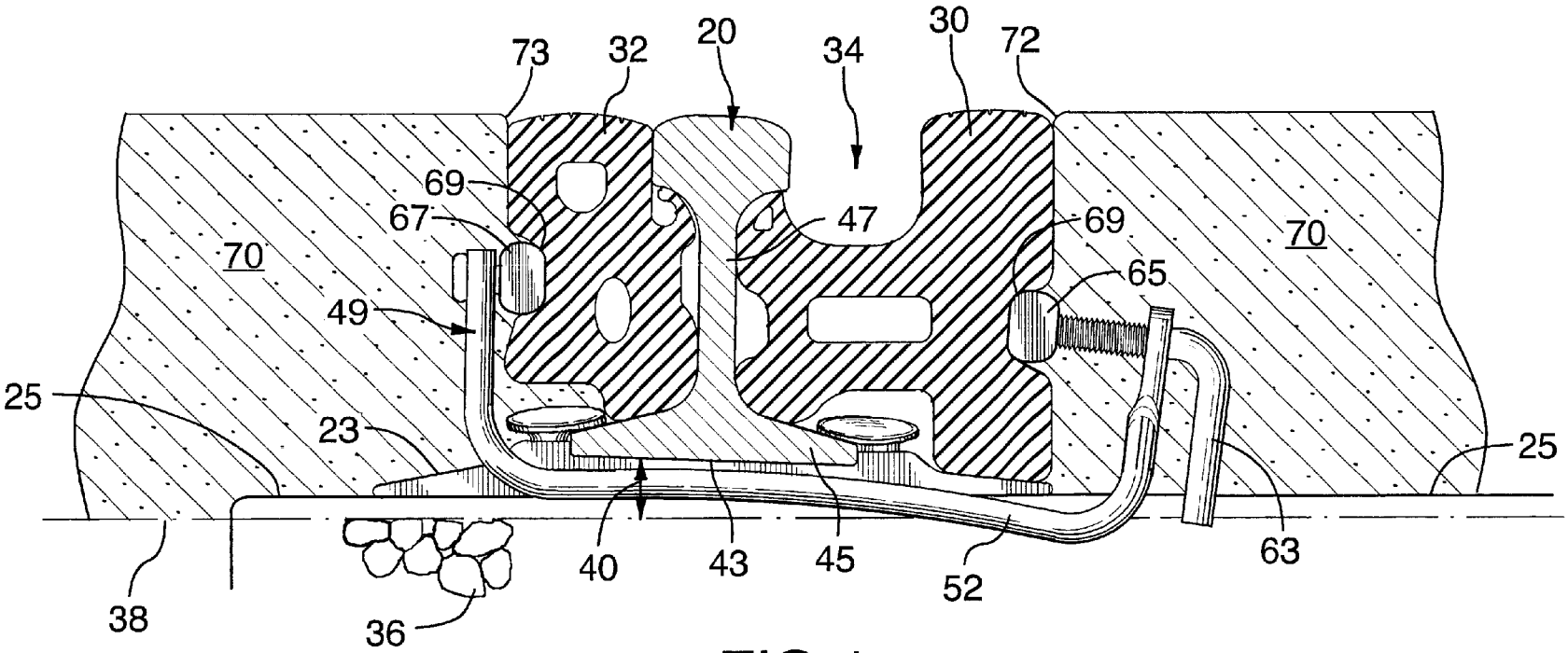
FIG. 1 is a sectioned end elevation of a section of railway track, at a rail-road crossing, showing sections of rubber interface, held in place by a spring-clip apparatus that embodies the invention.

In FIG. 1, the (steel) rail 20 is mounted in the usual way on a chair 23, which in turn is mounted on the usual cross-tie 25. Spikes 27 hold the rail and chair to the tie. (The other rail of the railway lies to the right in FIG. 1.) The profile of the track-side rubber interface 30 is quite different from the profile of the field-side interface 32, mainly because of the recess 34, which accommodates the flanges of passing railway wheels.

The cross-ties 25 are set in the usual ballast 36, the line 38 indicating the general level of the ballast. The ballast is set so that the level 38 is just below the level of the top of the cross-tie 25. Thus, as a general rule, in the area between the cross-ties, a gap 40 exists between the under-surface 43 of the base 45 of the rail 20, and the top 38 of the ballast 36. This gap 40 is in the region of 2 to 4 cm.

The two rubber interfaces 30,32 are held clamped against the sides of the web 47 of the rail 20 by means of the spring-clip 49. The spring-clip 49 passes underneath the base 45 of the rail, and lies in the gap 40. The FIG. 1 cross-section is taken at a point between two cross-ties; the spring-clip 49 is located half-way between the cross-ties; thus, in a case where the cross-ties lie, say, 60 cm apart, it will be understood that the chair 23 and tie 25 in FIG. 1 lie some 30 cm behind the spring-clip 49.

At a typical road/rail level crossing, several of the spring-clips 49 are used. The spring-clips are intercalated with the cross-ties lengthwise along the rails, right across the width of the road. Of course, the rubber interfaces and the spring-clips are duplicated for the other rail of the railway track. The rubber interface strips are made from extruded rubber, which comes in lengths of 2 to 4 metres. Where the road is wider than that (which it usually is) the rubber pieces are joined together lengthwise.

The strips of rubber 30,32 are placed against the sides of the rail, and then the spring-clips 30 are installed. The operator lays the spring-clips underneath the base of the rail, i.e through the gap 40 between the rail and the ballast. The spring-clip must be laid flat to accomplish this, and then the spring-clip is rotated until the arms of the spring-clip lie vertically, once the spring-clip is in place underneath the rail. It may be necessary to remove a few pebbles of the ballast, if the level 38 of the ballast is higher than usual, but generally the operator has ample room to install the spring-clips without touching the ballast.

Figure 2:
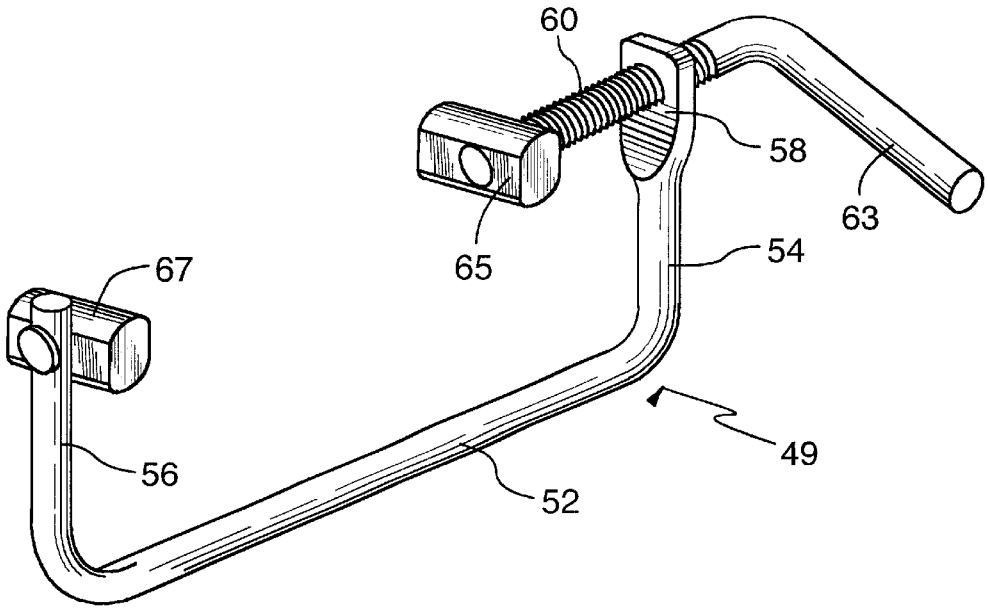
FIG. 2 is a portion of the same elevation, shown at a stage of installation.
Figure 3:
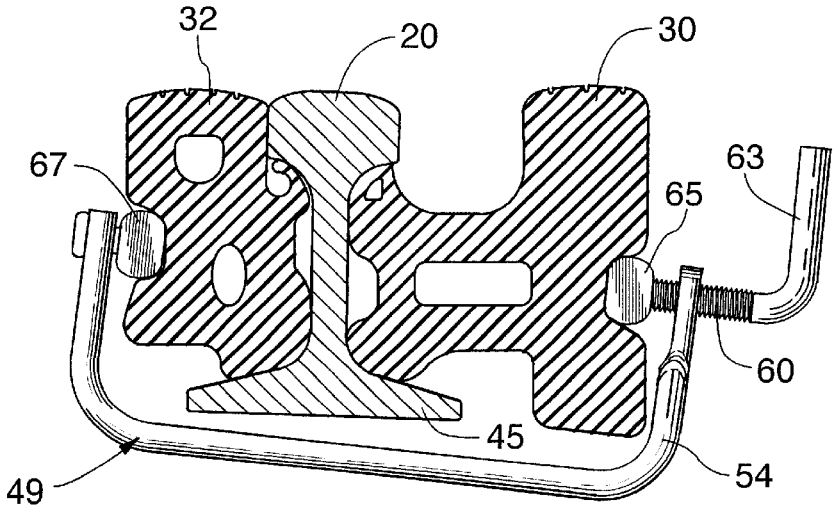
FIG. 3 is a view of the spring-clip of FIG. 1.

The spring-clip 49 is as shown in FIG. 2. The spring-clip includes a main beam 52, and two side-arms 54,56. One arm 54 is flattened at its end 58, and is provided with a threaded hole therein. A screwed rod 60 is screwed into the arm 54, and the rod is provided with a handle 63.

Carried on the end of the screwed rod 60 is a tappet 65. The tappet is so attached to the rod that the tappet can rotate; or rather, so that the tappet can remain still while the screwed rod rotates. A second tappet 67 is carried on the other arm 56. The tappet 67 need not be mounted for rotation, although it can be; and there is a manufacturing benefit if both tappets are the same.

The operator winds the handle 63, to unscrew the rod 60 a sufficient distance that the tappets can be easily slid into place, into the tappet-receiving-grooves 69, which are provided in the side profiles of the rubber pieces for receiving the tappets.

Now, the operator turns the handle 63, and winds the screwed rod so that the tappets 65,67 are driven towards each other. The arms 54,56 are spread apart by this action, and the beam 52 is put into a state of bending. The completed installation condition is as shown in FIG. 1.

For best results, the rubber pieces should be pressed against the rail with a clamping force at each spring-clip in the 2 or 3 kN range. It is recognised that such force is readily available with the kind of spring-clip as shown, i.e one in which the beam and arms are bent from round steel bar of about 15 or 20 mm diameter. The required distance between the tappets typically is around 20 cm, and the length of the arms is 9 cm, whereby the required force can be achieved when the arms are prised apart some 6 or 7 cm. The screw thread allows that distance to be taken up by simple hand action of the operator.

As shown in FIG. 1, the spring-clip is installed with the handle towards the track side. However, the spring-clip could be positioned with the handle towards the field-side, if preferred. If all the handles are on the same side, inspection to ensure that all the spring-clips are correctly installed is somewhat easier.

After the spring-clips are all installed, the road is made-up by pouring on asphalt 70, in the usual way.

Of course, the asphalt will not fill tightly into all the nooks and crannies around the spring-clips, even after being well-compacted. But it is the surface of the asphalt that counts, and the extent to which the asphalt starts to crumble, after a few years, at the points 72,73, that determines the length of time before re-asphalting has to take place.

These areas 72,73 are far enough away from the spring-clips not to be affected directly thereby. However, a prudent installation engineer would see to it that all the handles are pointing downwards prior to applying the asphalt.

One of the traditional problems with rubber interfaces of the kind described herein, when traditional fastening methods have been used, is that the rubber tends to wander—both to slip down or rotate down inside the rail profile, and also to slide lengthwise along the rail. After several years, sometimes the rubber interfaces have been quite severely displaced. When that happens, the asphalt is left unsupported, and can crumble badly. (It should be noted that the asphalt takes support from the rubber, not the other way round.)

But when the spring-clips as described herein are used, the rubber is attached to the rails very firmly indeed, and therefore the tendency of the rubber to wander and creep, as the years go by, is largely eliminated. The expectation is that the rubber will be in exactly the same place on the rail after several years, as it was the day the asphalt was poured. As a result, the asphalt may be expected to remain firm and coherent for several years, even in the areas 72,73. Traditionally, the shortcomings of the manner of attachment of the rubber to the rails has been the main factor leading to the need for early re-asphalting, and this shortcoming is exactly addressed by the new design of spring-clip. But of course, the asphalt can also break up because the ballast was not correctly set for the traffic, and that aspect becomes more important now that the asphalt can be expected not to deteriorate because of creeping of the rubber.

The spring-clips should be corrosion-protected. However, the standard of protection need not be high. Once the spring-clip is installed, it is protected by being covered by the asphalt, and besides it would take centuries for the spring-clip to rust enough to lose its locked-in forces. It does not matter if the screw-threads seize up due to corrosion. In a case where asphalt needed to be replaced, the spring-clips would have to be replaced also, although the rubber can usually be re-used. The act of removing the old asphalt would inevitably damage most of the spring-clips, and so the old spring-clips would be removed by bolt-cutters, or torches, not by trying to unwind the screwed rods.

The beam 52 is circular in cross-section. It might be considered that because the beam 52 of the spring-clip is stressed in bending that the beam should be of a rectangular section, or even an I-beam section. However, if the spring-clip were to fail because of over-stressing, it is likely that the mode of failure would be, not bending of the beam 52, but torsion-buckling of the arm 54. That being so, in fact circular is the preferred cross-section, besides being the least expensive. In fact, a slight flattening of the profile from the strictly circular is preferred, of the diameter in the plane of the clip. Slight variations in the diameter can affect the spring rate, and the flattening assists in keeping the rate as predicted. Besides, given that the spring-clip is highly stressed, in use, and the flattened surfaces represent the areas where the stress is at the highest, the flattening ensures that the stresses are well-distributed and accommodated. Also, the flattening assists in ensuring that the two bent-up arms are aligned in the same plane.

It should be noted that the bending moment on the beam 52 is constant, whereby the material of the main beam is being used efficiently. The spring-clip does not touch any part of the structure other than the grooves 69 in the side faces of the rubber profiles.

Thus, the spring-clip touches nothing but the grooves 69 after installation, but furthermore, in fact the spring-clip need touch nothing else during installation, despite the fact that large forces are being applied to the arms. The arms 54,56 of the spring-clip can be forced apart by the operator applying no other force than turning the handle.

This may be contrasted with a design in which, for example, in order to prise the arms apart, the manner of prising the arms apart required a force to be also exerted downwards onto the ballast. Such a design would be at a disadvantage because the ballast is not always at the same height.

The use of special tools might be contemplated for the installation work, but special tools generally are contra-indicated for level-crossing installation work. This is because of the nature of the contracting firms; level-crossing contracts are occasional (and they are likely to become even more occasional, now that the time between re-asphalting can be extended by the use of the spring-clip as described herein) and so special tools would be mislaid between jobs. A design that required a tool that could be economically supplied for each contract and then discarded after the contract was finished might be acceptable. However, preferably, the work should be of such a nature as not to require the use of tools, and especially not special tools.

The inexpensive screw thread system as described herein allows the force to be applied to prise the arms apart without the need for steadying forces or reactions, for example from the ballast or from the rail itself. And, once set, the arms stay locked apart.

There is virtually no failure mode under which the arms might suddenly collapse, and which might be dangerous to the operator. The system requires ballast to be excavated from below the rails only to a minimum extent, if at all. The system avoids the need for special tools, or indeed for tools at all, in that the spring-clips can be installed solely by the use of the hands.

Even though the spring-clips clamp the rubber strips onto the rail with considerable force, the operator can provide such force simply by turning the handle of the screwed rod. It may be noted that the operator cannot overload the spring-clip. The operator can only turn the handle until the thread bottoms out, and the designer can provide that when that occurs the desired load has been reached. In fact, the designer can provide that the operator simply turns the handle of every spring-clip until the thread bottoms out.

The number of spring-clips per crossing varies in the 50 to 100 range. The task of manipulating the spring-clips into place, and screwing the screwed rods at each spring-clip, can be undertaken by even the most casual of workers. All the workers can be set to the task of screwing the screwed rods; this may be contrasted with bending over the spikes in the traditional system, where there might be only one skilled spike-driver available to attend to all the spikes.

The spring-clips should not be made too large. Preferably, it should be possible to manipulate the fully open (i.e retracted) spring-clip around the strips, but only just. Then, if the strips are not fully in place against the side of the rail, that fact will be apparent to the worker in that he now has difficulty in getting the spring-clip to straddle the strips. If that is encountered, he knows to kick the strip more firmly against the rail.

Figure 4:
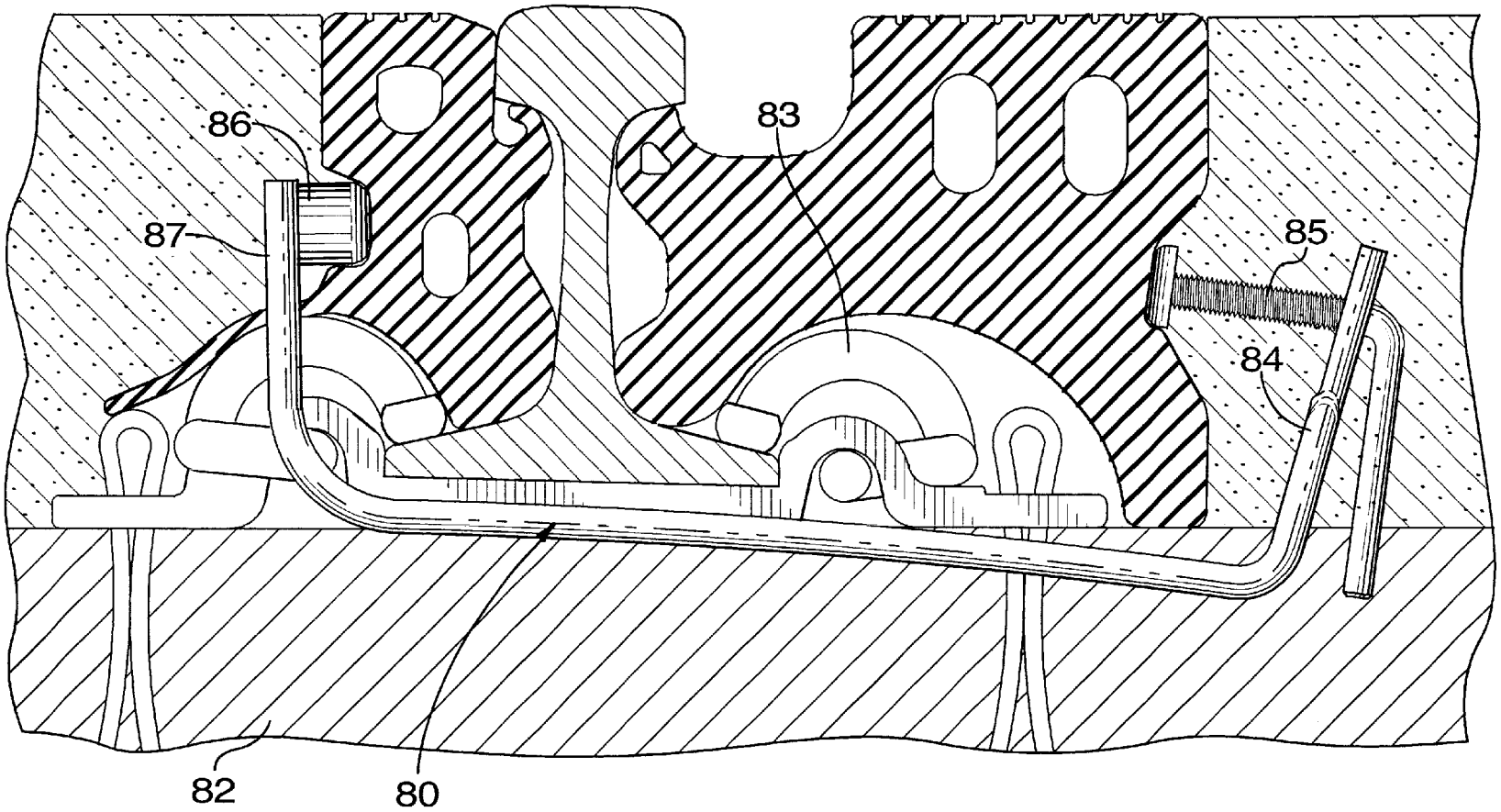
FIG. 4 is a cross-section of railway track, in which the cross-ties are of concrete, and the rails are secured to the cross-ties with pandrol clips.

FIG. 4 shows an example of a spring-clip 80 of the type as described herein applied to a railway system that uses concrete cross-ties 82. (Sometimes, cross-ties are made of metal, and a similar spring-clip can be used in that case too.) FIG. 4 shows the use of pandrol-clips 83 to hold the base of the rail down onto the cross-tie. In FIG. 4, the alignment of the right arm 84, and of the threaded hole therein, is such that the axis of the threaded tappet-rod 85 is in a straight-line alignment with the left tappet 86 at the condition of maximum load, when the left and right arms 87,84 have been bent apart. There might be a tendency for the tappet-rod 85 to buckle, in an extreme case, and this tendency might be exacerbated if the tappet-rod were to lie at an angle to the line of the force under the conditions of maximum force.

Figure 5:
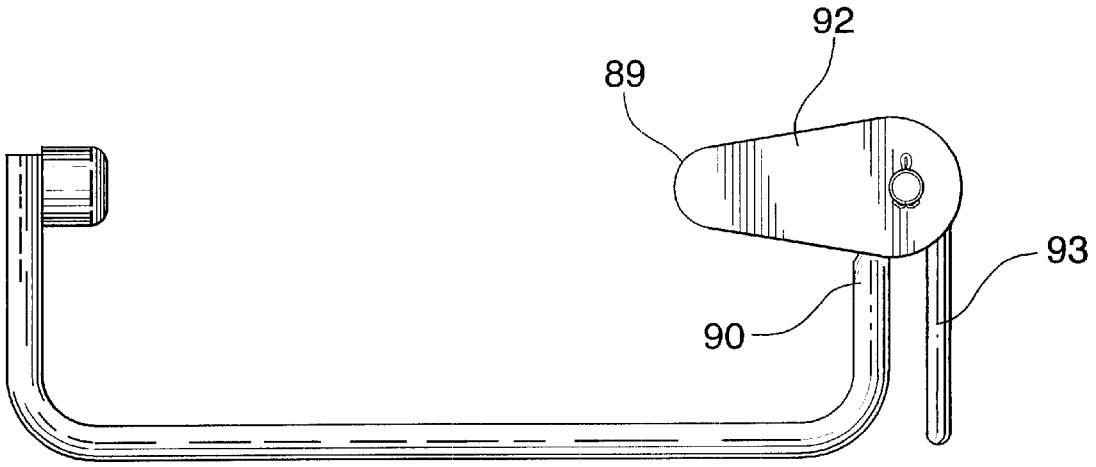
FIG. 5 is an elevation of a spring-clip, showing another spring-clip apparatus that embodies the invention.

FIG. 5 shows another example of a spring-clip. In this case, the means for adjusting the distance between the right tappet 89 and the right arm 90 is a cam 92, which is operated by turning the lever 93.

Figure 6:
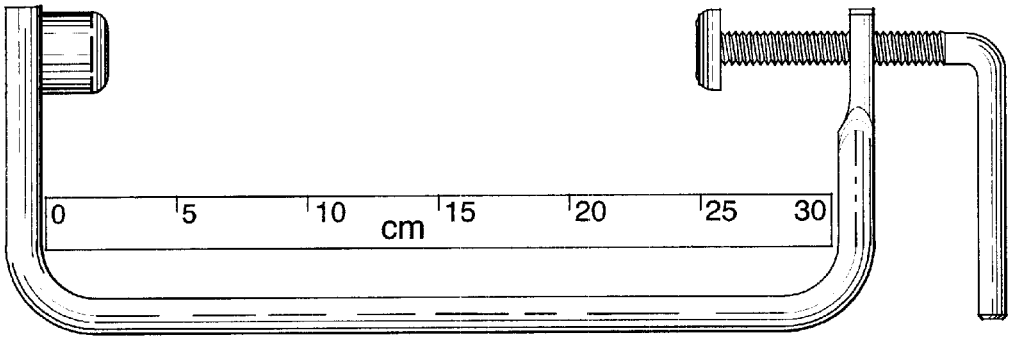
FIG. 6 is an elevation, which includes a scale, of a preferred form of spring-clip.

FIG. 6 is a scaled view of an exemplary spring-clip. The span of spring-clip, i.e the length of the beam portion of the spring-clip, in this case is about 32 cm. This distance is set in accordance with the requirements for straddling the two interface strips assembled to the sides of the rail. The designer would have to increase (decrease) the span of the beam if the straddle distance were larger (smaller).

It will be understood that the main function of the spring-clip is to provide a particular desired level of force, for holding the two interface strips against the sides of the rail. If the clamping force were too large, that would be wasteful, and the strips might even be distorted, or pushed out of position, by too heavy a force. On the other hand, the force should not be too light, because then the strips might be a little out of position, or might move during pouring of the asphalt or concrete, or be otherwise improperly hold. As mentioned, it is recognised that the force of clamping preferably should be in the 2–3 kN range.

Thus, the designer wishes to ensure that all the spring-clips exert a force in the 2–3 kN range. However, the designer cannot expect the installation workers to measure the clamping force, as such. Rather, the workers preferably should be called upon merely to set the spring-clip to a particular deflection, and not to carry out the much more sophisticated task of setting the clips to a particular level of force, as such.

The designer preferably should set the installation worker the task, not of tightening a screw until a certain force is achieved, but the much easier task of merely of tightening a screw to a stop.

The task of the designer is to ensure that, when the arms of the spring-clip have been bent apart to a particular distance, the force produced between the arms for clamping the strips to the rail then will inevitably be within the desired range.

However, the rubber strips are subject to dimensional tolerance variations, and these variations can be quite considerable, given the nature of extruded rubber. Also, the shape of conventional railway rails is hardly conducive to accurately repeatable positioning of the rubber strips against the rails. For these reason, the distance apart of the tappet-receiving-grooves on the strips can vary to a considerable degree. A difference of 1 cm is common, and even as much as 2 cm might be encountered, in what is nominally supposed to be the same groove-to-groove straddle dimension.

This possibility for large variations in the straddle distance makes it all the more difficult to ensure that the desired force of 2–3 kN is present when the spring-clip has been assembled and installed. The designer should aim for a sufficiently low spring-rate of the spring-clip to enure that, even though the deflected-apart distance might vary by a centimetre or two from one spring-clip to another, the deflected-apart force is always still within the desired range.

On the other hand, too low a spring-rate would mean that the operator had to deflect the arms through an inordinately long distance in order to achieve the desired clamp force. A spring rate of 400–700 Newtons per cm of deflection of the arms (i.e per cm of separation of the tappets) has been found to give a good balance between, on the one hand, the accommodation of the large tolerance band, and on the other hand, the need to move the arms apart only a modest distance.

It should be noted that the desired force for holding the rubber strips to the rail, i.e the 2–3 kN, applies even when the strips are done to different designs. For example, some strips have a wide profile and need the spring-clips to have a large straddle-distance or span; whereas other strips, which have to accommodate different types of track clips for example, can be quite narrow. In these cases, the designer would provide that the beam portion of the spring-clip would be long or short, as required.

It should be noted that the spring-rate of the spring-clip is proportional to the span of the spring-clip. Whatever the particular length of beam, as dictated by the span required to straddle the strips, the designer should arrange for the spring-clip to have a rate of 400–700 N per cm at the tappets. If the span of the beam has to be long, the designer should specify a somewhat larger diameter for the bar from which the spring-clip is made, in order to achieve a spring-rate in the 400–700 N per cm range, at the tappets. (In other words, the designer should have it in mind that he is designing a spring-clip, as distinct from a rigid screw-cramp.)

It should also be noted that there can be quite large variations in the slack take-up distance that the spring-clip must accommodate. The worker might have to turn the screw through a distance of say 5 cm on spring-clip A before the tappet has bottomed onto the groove, whereas the slack take-up at spring-clip B might be only 3 cm. Again, the designer does not wish to leave it to the installation worker to determine the point at which the slack is fully taken up, and further turning of the screw will now lead to bending the arms of the spring-clip apart. The designer provides simply that the worker turns the screw until the screw can turn no further. But the total distance turned by the screw aggregates the slack take-up distance and the bend-the-arms distance. If the slack take-up distance at spring-clip A happens to be smaller than the slack take-up distance at spring-clip B. the arms of spring-clip A will be bent apart further than the arms of spring-clip B, when the screws of both spring-clips are bottomed out. It is recognised that the spring-rates and other characteristics as described herein allow the designer to accommodate such variations.

In FIG. 6, the maximum separation of the tappets, with the screw wound fully back to the right, is 29 cm. When the screw is fully wound forwards, until it bottoms, the separation of the tappets is 22 cm. The rubber strips of course do become compressed by the action of the spring-clip, but in fact the rubber is much less compressible than the arms of the spring-clip. In FIG. 6, the bar is a nominal (slightly flattened, as mentioned). The screw-thread is nominal 13 cm.

What is claimed is:

1. Apparatus for securing interface strips to the sides of the rails at a road-rail crossing, wherein:

the apparatus is suitable for use in conjunction with a rail and a pair of the interface strips, being a field-side strip and a gauge-side strip, one of which is located to the right side, and the other to the left side, of the rail;

the strips have respective side-surfaces which, when the strips are fitted to the rail, face away from the rail;

the apparatus includes a spring-clip, which is made of metal;

the spring-clip is of a U-configuration, having a central beam and having left and right arms;

the apparatus includes left and right tappets, which are arranged for contact with left and right tappet-receiving points on the side-surfaces of the strips;

the apparatus includes a means for connecting the right tappet to a right tappet-receiving location on the spring-clip, and a means for mounting the left tappet at a left tappet-receiving location on the spring-clip;

the means for connecting the right tappet to the right tappet-receiving location is of such a structure that the distance between the right tappet and the right tappet-receiving location can be adjusted in a directional sense towards and away from the left tappet;

the apparatus includes an operable adjustable lock for adjusting the distance between the right tappet and the right tappet-receiving location;

and the structure and springiness of the arms and the beam of the spring-clip are such that the arms are capable of being deflected apart a deflection-distance DDef without taking a permanent set, the deflection distance DDef being at least 12 cm measured along a line joining the left and right tappet-receiving locations on the arms.

2. Apparatus of claim 1, wherein the structure and so springiness of the arms and of the beam are such that the force needed to deflect the arms the said deflection-distance DDef apart is at least 5 kN of force.

3. Apparatus for securing interface strips to the sides of the rails at a road-rail crossing, wherein:

the apparatus is suitable for use in conjunction with a rail and a pair of the interface strips, being a field-side strip and a gauge-side strip, one of which is located to the right side, and the other to the left side, of the rail;

the strips have respective side-surfaces which, when the strips are fitted to the rail, face away from the rail;

the apparatus includes a spring-clip, which is made of metal;

the spring-clip is of a U-configuration, having a central beam and having left and right arms;

the apparatus includes left and right tappets, which are arranged for contact with left and right tappet-receiving points on the side-surfaces of the strips;

the apparatus includes a means for connecting the right tappet to a right tappet-receiving location on the spring-clip, and a means for mounting the left tappet at a left tappet-receiving location on the spring-clip;

the means for connecting the right tappet to the right tappet-receiving location is of such a structure that the distance between the right tappet and the right tappet-receiving location can be adjusted in a directional sense towards and away from the left tappet;

the apparatus includes an operable adjustable lock for adjusting the distance between the right tappet and the right tappet-receiving location;

and the spring-clip has a spring-rate in that the force required to deflect the arms apart, measured along a line joining the left and right tappet receiving locations on the arms, is between 400 and 700 Newtons per cm of deflection.

4. Apparatus for securing interface strips to the sides of the rails at a road-rail crossing, wherein:

the apparatus is suitable for use in conjunction with a rail and a pair of the interface strips, being a field-side strip and a gauge-side strip, one of which is located to the right side, and the other to the left side, of the rail;

the strips have respective side-surfaces which, when the strips are fitted to the rail, face away from the rail;

the apparatus includes a spring-clip, which is made of metal:

the spring-clip is of a U-configuration, having a central beam and having left and right arms;

the apparatus includes left and right tappets, which are arranged for contact with left and right tappet-receiving points on the side-surfaces of the strips;

the apparatus includes a means for connecting the right tappet to a right tappet-receiving location on the spring-clip, and a means for mounting the left tappet at a left tappet-receiving location on the spring-clip;

the means for connecting the right tappet to the right tappet-receiving location is of such a structure that the distance between the right tappet and the right tappet-receiving location can be adjusted in a directional sense towards and away from the left tappet;

the apparatus includes an operable adjustable lock for adjusting the distance between the right tappet and the right tappet-receiving location;

the right tappet is carried on a tappet-rod, and the tappet-rod is screw-threaded to the right arm, and the adjustable lock is provided by the screw-thread between the tappet-rod and the right arm;

and the axis of the screw-thread in the right arm is so aligned relative to the arm that the axis passes through the left tappet when the arms are deflected apart.

5. Apparatus for securing interface strips to the sides of the rails at a road-rail crossing, wherein:

the apparatus is suitable for use in conjunction with a rail and a pair of the interface strips, being a field-side strip and a gauge-side strip, one of which is located to the right side, and the other to the left side, of the rail;

the strips have respective side-surfaces which, when the strips are fitted to the rail, face away from the rail;

the apparatus includes a spring-clip, which is made of metal;

the spring-clip is of a U-configuration, having a central beam and having left and right arms;

the apparatus includes left and right tappets, which are arranged for contact with left and right tappet-receiving points on the side-surfaces of the strips;

the apparatus includes a means for connecting the right tappet to a right tappet-receiving location on the spring-clip, and a means for mounting the left tappet at a left tappet-receiving location on the spring-clip;

the means for connecting the right tappet to the right tappet-receiving location is of such a structure that the distance between the right tappet and the right tappet-receiving location can be adjusted in a directional sense towards and away from the left tappet;

the apparatus includes an operable adjustable lock for adjusting the distance between the right tappet and the right tappet-receiving location;

the right tappet is carried on a tappet-rod, and the tappet-rod is screw-threaded to the right arm, and the adjustable lock is provided by the screw-thread between the tappet-rod and the right arm;

the apparatus is combined with the left and right interface strips, wherein:

the strips are provided with respective left and right tappet-positioning-grooves in their respective side-surfaces;

the tappet-positioning-grooves are deep enough that, when the tappets are in the grooves, the spring-clip is thereby supported in the grooves without any other support, and is held supported thereby when the adjustable lock is operated, thereby bending the arms apart, and applying a heavy force clamping the two strips to the sides of the rail;

and the spring-clip is so dimensioned that, when a first one of the tappets is in the tappet-positioning-groove of a first one of the strips, and the adjustable lock is set to a maximum distance apart of the tappets, the other one of the tappets can be passed over the extremity of the other one of the strips, and assembled into the tappet-positioning-groove in the other one of the strips, substantially without any deflection of the spring-clip.

6. Apparatus for securing interface strips to the sides of the rails at a road-rail crossing, wherein:

the apparatus is suitable for use in conjunction with a rail and a pair of the interface strips, being a field-side strip and a gauge-side strip, one of which is located to the right side, and the other to the left side, of the rail;

the strips have respective side-surfaces which, when the strips are fitted to the rail, face away from the rail;

the apparatus includes a spring-clip, which is made of metal;

the spring-clip is of a U-configuration, having a central beam and having left and right arms;

the apparatus includes left and right tappets, which are arranged for contact with left and right tappet-receiving points on the side-surfaces of the strips;

the apparatus includes a means for connecting the right tappet to a right tappet-receiving location on the spring-clip, and a means for mounting the left tappet at a left tappet-receiving location on the spring-clip;

the means for connecting the right tappet to the right tappet-receiving location is of such a structure that the distance between the right tappet and the right tappet-receiving location can be adjusted in a directional sense towards and away from the left tappet;

the apparatus includes an operable adjustable lock for adjusting the distance between the right tappet and the right tappet-receiving location;

the right tappet is carried on a tappet-rod, and the tappet-rod is screw-threaded to the right arm, and the adjustable lock is provided by the screw-thread between the tappet-rod and the right arm;

the apparatus is combined with the left and right interface strips, wherein:

the strips are provided with respective left and right tappet-positioning-grooves in their respective side-surfaces;

the tappet-positioning-grooves are deep enough that, when the tappets are in the grooves, the spring-clip is thereby supported in the grooves without any other support, and is held supported thereby when the adjustable lock is operated, thereby bending the arms apart, and applying a heavy force clamping the two strips to the sides of the rail;

and the strips are so dimensioned that a slack-take-up distance through which the adjustable lock has to be moved before both tappets are tight in their respective tappet-receiving-grooves is between 2 and 4 cm.

7. Apparatus of claim 6, wherein the spring-clip is so configured that, from a condition in which both tappets are tight in their respective tappet receiving-grooves, the right tappet can be adjusted, thereby bending the arms apart, through a further 6 cm.

8. Apparatus for securing interface strips to the sides of the rails at a road-rail crossing, wherein:

the apparatus is suitable for use in conjunction with a rail and a pair of the interface strips, being a field-side strip and a gauge-side strip, one of which is located to the right side, and the other to the left side, of the rail;

the strips have respective side-surfaces which, when the strips are fitted to the rail, face away from the rail;

the apparatus includes a spring-clip, which is made of metal;

the spring-clip is of a U-configuration, having a central beam and having left and right arms;

the apparatus includes left and right tappets, which are arranged for contact with left and right tappet-receiving points on the side-surfaces of the strips;

the apparatus includes a means for connecting the right tappet to a right tappet-receiving location on the spring-clip, and a means for mounting the left tappet at a left tappet-receiving location on the spring-clip;

the means for connecting the right tappet to the right tappet-receiving location is of such a structure that the distance between the right tappet and the right tappet-receiving location can be adjusted in a directional sense towards and away from the left tappet;

the apparatus includes an operable adjustable lock for adjusting the distance between the right tappet and the right tappet-receiving location;

the right tappet is carried on a tappet-rod, and the tappet-rod is screw-threaded to the right arm, and the adjustable lock is provided by the screw-thread between the tappet-rod and the right arm;

the apparatus is combined with the left and right interface strips, wherein:

the strips are provided with respective left and right tappet-positioning-grooves in their respective side-surfaces, the tappet-positioning-grooves are deep enough that, when the tappets are in the grooves, the spring-clip is thereby supported in the grooves without any other support, and is held supported thereby when the adjustable lock is operated, thereby bending the arms apart, and applying a heavy force clamping the two strips to the sides of the rail;

and the apparatus includes many of the spring-clips, arranged in an intercalated relationship with the railway cross-ties.

* * * * *